US007517202B2

(12) United States Patent
Delpassand

(10) Patent No.: US 7,517,202 B2
(45) **Date of Patent: *Apr. 14, 2009**

(54) MULTIPLE ELASTOMER LAYER PROGRESSING CAVITY STATORS

(75) Inventor: Majid S. Delpassand, Houston, TX (US)

(73) Assignee: Smith International, Inc., Houston, TX (US)

( * ) Notice: Subject to any disclaimer, the term of this patent is extended or adjusted under 35 U.S.C. 154(b) by 124 days.

This patent is subject to a terminal disclaimer.

(21) Appl. No.: 11/034,075

(22) Filed: Jan. 12, 2005

(65) Prior Publication Data

US 2006/0153724 A1 Jul. 13, 2006

(51) Int. Cl.
*F01C 1/10* (2006.01)
*F01C 5/00* (2006.01)

(52) U.S. Cl. ..... 418/48; 418/158

(58) Field of Classification Search ..... 492/56; 418/48, 45; 417/410.3, 410.4
See application file for complete search history.

(56) References Cited

U.S. PATENT DOCUMENTS

| | | | | |
|---|---|---|---|---|
| 2,527,673 | A | | 10/1950 | Byram |
| 3,084,631 | A | | 4/1963 | Bourke |
| 3,139,035 | A | | 6/1964 | O'Connor |
| 3,417,664 | A | | 12/1968 | Brucker |
| 3,499,389 | A | | 3/1970 | Seeberger et al. |
| 3,822,972 | A | | 7/1974 | Ogly et al. |
| 3,840,080 | A | | 10/1974 | Berryman |
| 3,857,654 | A | | 12/1974 | Steicher |
| 3,912,426 | A | | 10/1975 | Tschirky |
| 3,975,120 | A | | 8/1976 | Tschirky |
| 4,104,009 | A | | 8/1978 | Chanton |
| 4,144,001 | A | | 3/1979 | Steicher |
| 4,265,323 | A | | 5/1981 | Juergens |
| 4,415,316 | A | | 11/1983 | Jurgens |
| 4,558,991 | A | | 12/1985 | Barr |
| 4,614,232 | A | | 9/1986 | Jurgens et al. |
| 4,636,151 | A | | 1/1987 | Eppink |
| 4,676,725 | A | | 6/1987 | Eppink |
| 4,718,824 | A | | 1/1988 | Cholet et al. |
| 4,991,292 | A | | 2/1991 | Bostel |
| 5,064,889 | A | * | 11/1991 | Ikeno ..... 524/188 |
| 5,090,497 | A | | 2/1992 | Beimgraben et al. |
| 5,145,342 | A | | 9/1992 | Gruber |
| 5,171,138 | A | | 12/1992 | Forrest |
| 5,171,139 | A | | 12/1992 | Underwood et al. |
| 5,257,967 | A | * | 11/1993 | Gysin ..... 492/56 |
| 5,700,888 | A | * | 12/1997 | Hall ..... 526/190 |
| 5,759,019 | A | | 6/1998 | Wood et al. |

(Continued)

FOREIGN PATENT DOCUMENTS

DE 1528978 A1 7/1969

(Continued)

*Primary Examiner*—Thomas Denion
*Assistant Examiner*—Douglas J. Duff

(57) ABSTRACT

A progressing cavity stator and a method for fabricating such a stator are disclosed. The progressing cavity stator includes first and second elastomer layers fabricated from corresponding first and second elastomer materials. The first and second elastomer materials are selected to have at least one distinct material property. Exemplary embodiments of this invention may reduce tradeoffs associated with elastomer material selection and may further address the heat build up and subsequent elastomer breakdown in the lobes of prior art stators.

21 Claims, 4 Drawing Sheets

U.S. PATENT DOCUMENTS

| | | | | |
|---|---|---|---|---|
| 6,019,583 | A | 2/2000 | Wood | |
| 6,183,226 | B1 * | 2/2001 | Wood et al. | 418/48 |
| 6,190,771 | B1 * | 2/2001 | Chen et al. | 428/375 |
| 6,224,526 | B1 * | 5/2001 | Stimmelmayr et al. | 492/56 |
| 6,241,494 | B1 | 6/2001 | Pafitis et al. | |
| 6,309,195 | B1 | 10/2001 | Bottos et al. | |
| 6,336,796 | B1 * | 1/2002 | Cholet et al. | 418/48 |
| 6,427,787 | B1 | 8/2002 | Jager | |
| 6,543,132 | B1 | 4/2003 | Krueger et al. | |
| 6,568,076 | B2 | 5/2003 | Bottos et al. | |
| 6,604,921 | B1 | 8/2003 | Plop et al. | |
| 6,881,045 | B2 * | 4/2005 | Zitka et al. | 418/48 |
| 6,935,995 | B2 * | 8/2005 | Siebert et al. | 492/56 |
| 7,083,401 | B2 * | 8/2006 | Hooper | 418/48 |

FOREIGN PATENT DOCUMENTS

| | | | |
|---|---|---|---|
| DE | 3503604 | A1 | 8/1986 |
| DE | 19531318 | A1 | 2/1997 |
| EP | 0358789 | A | 3/1990 |
| GB | 2081812 | A | 2/1982 |

* cited by examiner

MULTIPLE ELASTOMER LAYER PROGRESSING CAVITY STATORS

RELATED APPLICATIONS

None.

FIELD OF THE INVENTION

The present invention relates generally to positive displacement progressing cavity drilling motors, typically for downhole use. This invention more specifically relates to progressing cavity stators having multiple internal elastomer layers and a method for fabricating stators having multiple elastomer layers.

BACKGROUND OF THE INVENTION

Progressing cavity hydraulic motors and pumps (also known in the art as Moineau style motors and pumps) are conventional in subterranean drilling and artificial lift applications, such as for oil and/or gas exploration. Such progressing cavity motors make use of hydraulic power from drilling fluid to provide torque and rotary power, for example, to a drill bit assembly. The power section of a typical progressing cavity motor includes a helical rotor disposed within the helical cavity of a corresponding stator. When viewed in circular cross section, a typical stator shows a plurality of lobes in the helical cavity. In most conventional Moineau style power sections, the rotor lobes and the stator lobes are preferably disposed in an interference fit, with the rotor including one fewer lobes than the stator. Thus, when fluid, such as a conventional drilling fluid, is passed through the helical spaces between rotor and stator, the flow of fluid causes the rotor to rotate relative to the stator (which may be coupled, for example, to a drill string). The rotor may be coupled, for example, through a universal connection and an output shaft to a drill bit assembly.

Conventional stators typically include a helical cavity component bonded to an inner surface of a steel tube. The helical cavity component in such conventional stators typically includes an elastomer (e.g., rubber) and provides a resilient surface with which to facilitate the interference fit with the rotor. Many stators are known in the art in which the helical cavity component is made substantially entirely of a single elastomer layer.

It has been observed that during operations, the elastomer portions of conventional stator lobes are subject to considerable cyclic deflection, due at least in part to the interference fit with the rotor and reactive torque from the rotor. Such cyclic deflection is well known to cause a significant temperature rise in the elastomer. In conventional stators, especially those in which the helical cavity component is made substantially entirely from a single elastomer layer, the greatest temperature rise often occurs at or near the center of the helical lobes. The temperature rise is known to degrade and embrittle the elastomer, eventually causing cracks, cavities, and other types of failure in the lobes. Such elastomer degradation is known to reduce the expected operational life of the stator and necessitate premature replacement thereof. Left unchecked, degradation of the elastomer will eventually undermine the seal between the rotor and stator (essentially destroying the integrity of the interference fit), which results in fluid leakage therebetween. The fluid leakage in turn causes a loss of drive torque and eventually may cause failure of the motor (e.g., stalling of the rotor in the stator) if left unchecked.

Moreover, since such prior art stators include thick elastomer lobes, selection of the elastomer material necessitates a compromise in material properties to minimize lobe deformation under operational stresses and to achieve a suitable seal between rotor and stator. However, it has proved difficult to produce suitable elastomer materials that are both (i) rigid enough to prevent distortion of the stator lobes during operation (which is essential to achieving high drilling or pumping efficiencies) and (ii) resilient enough to perform the sealing function at the rotor stator interface. One solution to this problem has been to increase the length of power sections utilized in subterranean drilling applications. However, increasing stator length tends to increase fabrication complexity and also increases the distance between the drill bit and downhole logging sensors. It is generally desirable to locate logging sensors as close as possible to the drill bit, since they tend to monitor conditions that are remote from the bit when located distant from the bit.

Stators including a rigid helical cavity component have been developed to address this problem. For example, U.S. Pat. No. 5,171,138 to Forrest and U.S. Pat. No. 6,309,195 to Bottos et al. disclose stators having helical cavity components in which a thin elastomer liner is deployed on the inner surface of a rigid, metallic stator former. The '138 patent discloses a rigid, metallic stator former deployed in a stator tube. The '195 patent discloses a "thick walled" stator having inner and outer helical stator profiles. The use of such rigid stators is disclosed to preserve the shape of the stator lobes during normal operations (i.e., to prevent lobe deformation) and therefore to improve stator efficiency and torque transmission. Moreover, such metallic stators are also disclosed to provide greater heat dissipation than conventional stators including elastomer lobes.

While rigid stators have been disclosed to improve the performance of downhole power sections (e.g., to improve torque output), fabrication of such rigid stators is complex and expensive as compared to that of the above described conventional elastomer stators. Most fabrication processes utilized to produce long, internal, multi-lobed helixes are tooling intensive (such as helical broaching) and/or slow (such as electric discharge machining). As such, rigid stators of the prior art are often only used in demanding applications in which the added expense is acceptable.

U.S. Pat. No. 6,183,226 to Wood et al. and co-pending U.S. patent application Ser. No. 10/694,557, which is commonly assigned with the present application, disclose stators in which the helical cavity component includes an elastomer liner deployed on a fiber reinforced composite reinforcement material. While the use of composite reinforced stators has been found to be serviceable in reducing thermal degradation and increasing the rigidity of the stator lobes, there is room for yet further improvement. For example, fabrication of stator components including fiber reinforced composite materials tends to be complex as compared to that of the above described conventional elastomer stators.

Therefore, there exists a need for yet further improved stators for progressing cavity drilling motors, and in particular stators exhibiting longer service life and improved efficiency in demanding downhole applications.

SUMMARY OF THE INVENTION

The present invention addresses one or more of the above-described drawbacks of conventional progressing cavity motors and pumps. Aspects of this invention include a progressing cavity stator for use in such motors and/or pumps, such as in a downhole drilling assembly. The progressing cavity stator includes an internal helical cavity component having a plurality of elastomer layers. Each elastomer layer has at least one property of the elastomer material (e.g., chemical, mechanical, and/or physical property) that is distinct from that of the other elastomer layer(s). For example, in one exemplary embodiment, a progressing cavity stator according to this invention includes first and second elastomer layers, with the second layer being more resilient than the first layer.

Exemplary embodiments of the present invention advantageously provide several technical advantages. For example, the elastomer layers may be selected such that distinct properties of the elastomer layers complement one another, thereby improving stator performance and reducing tradeoffs associated with elastomer material selection. Exemplary embodiments of this invention may thus address the heat build up and subsequent elastomer breakdown in the lobes of prior arts stators. As such, various embodiments of the progressing cavity stator of this invention may exhibit prolonged service life as compared to conventional progressing cavity stators. Tools embodying this invention may thus display improved reliability. Further, exemplary stator embodiments of this invention may exhibit improved efficiency (and may thus provide improved torque output when used in power sections) as compared to conventional stators including a single elastomer layer. Moreover, embodiments of this invention may advantageously utilize conventional elastomer fabrication techniques, thereby simplifying the fabrication procedure, for example, as compared to stators including metallic or fiber reinforced composite lobes.

In one aspect, this invention includes a progressing cavity stator. The stator includes an outer tube and a helical cavity component deployed substantially coaxially in the outer tube. The helical cavity component provides an internal helical cavity and includes a plurality of internal lobes. The helical cavity component further includes first and second elastomer layers of corresponding first and second elastomer materials, each of the first and second elastomer materials selected to have at least one distinct material property. The outer tube retains the first elastomer layer, and the second elastomer layer is deployed on the first elastomer layer.

In another aspect, this invention includes a method for fabricating a progressing cavity stator. The method includes providing first and second stator cores, each of which has at least one helical lobe on an outer surface thereof, the first stator core having major and minor diameters greater than those of the second stator core. The method further includes inserting the first stator core substantially coaxially into a stator tube such that a first helical cavity is formed between the first stator core and the stator tube, injecting a first elastomer material into the first helical cavity to form a first elastomer layer, the first elastomer layer retained by the stator tube, and removing the first stator core. The method still further includes inserting the second stator core substantially coaxially into the stator tube such that a second helical cavity is formed between the second stator core and the first elastomer layer, injecting a second elastomer material into the second helical cavity to form a second elastomer layer, the second elastomer material selected to have at least one distinct material property from first elastomer material, the second elastomer layer retained by the first elastomer layer, and removing the second stator core.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

FIGS. 1, 3, 5, and 7 each depict circular cross-sections through Moineau style power sections in an exemplary 4/5 design. In such a design, the differing helical configurations on the rotor and the stator provide, in circular cross section, 4 lobes on the rotor and 5 lobes on the stator. It will be appreciated that this 4/5 design is depicted purely for illustrative purposes only, and that the present invention is in no way limited to any particular choice of helical configurations for the power section design.

Figure 1:
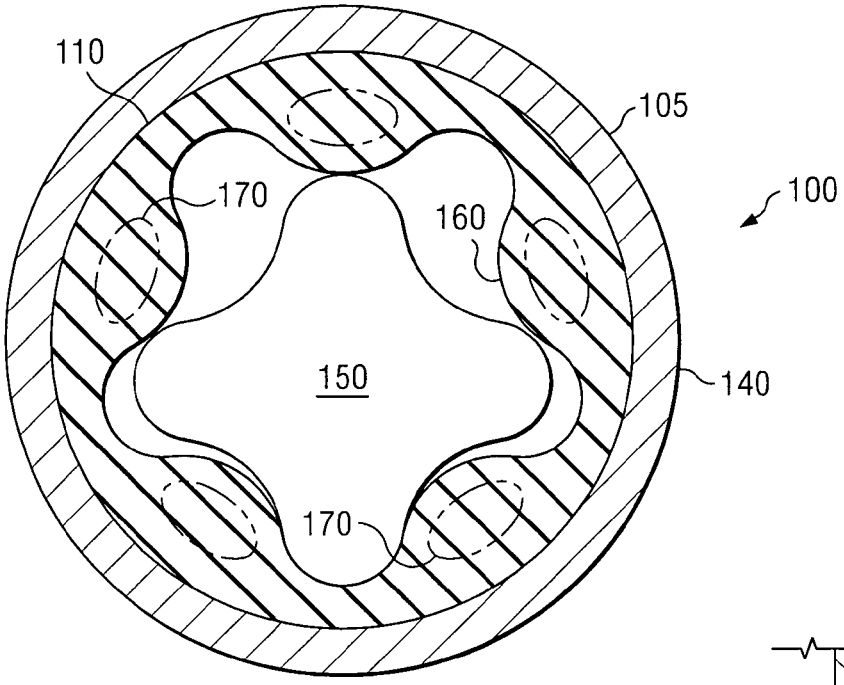
FIG. 1 (PRIOR ART)
FIG. 1 is a circular cross sectional view of a prior art stator.

FIG. 1 depicts a conventional Moineau style power section 100 in circular cross-section, in which stator 105 provides a helical cavity portion 110. In the embodiment of FIG. 1, helical cavity portion 110 is of an all-elastomer construction, including a single elastomer layer. Rotor 150 is deployed within stator 105. Stator 105 further comprises outer tube 140. Helical cavity portion 110 is deployed on the inside of outer tube 140, as is well known in the art.

FIG. 1 illustrates zones 170 in lobes 160 in which heat build up is known to occur as a result of elastomer hysteresis during operation of power section 100. As described above, the cyclic deflection and rebound of elastomer in the interference fit between rotor 150 and stator 105 contributes to the heat build up in zones 170. Reactive torque from rotor 150 may also contribute to heat build up. As the temperature rises, it tends to deteriorate the elastomer in zones 170, which eventually may cause cavities, cracks, and/or other types of failure to occur in these zones 170.

In an attempt to overcome such elastomer degradation, care is often exercised in the choice of an elastomer material (and its properties) utilized to form helical cavity portion 110. However, due to the behavior of the selected elastomer material in various competing conditions, there are inevitable tradeoffs in the choice of a desired elastomer material. Such tradeoffs typically result in the selected elastomer having at least one less-than-optimal material property (e.g., lower-than-desired temperature resistance, or alternatively lower-than-desired resilience) and as described above, these tradeoffs tend to compromise stator integrity and/or performance over the operational life of the stator.

Figure 2:
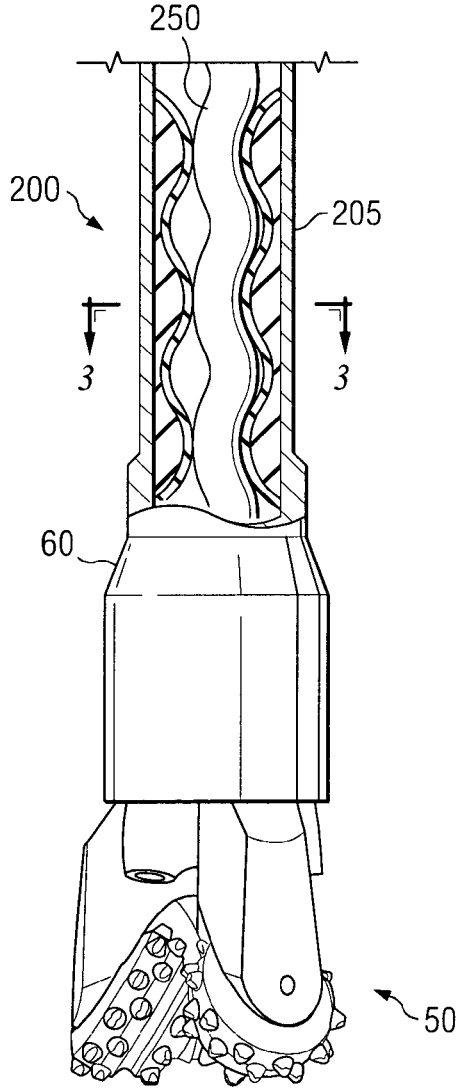
FIG. 2 depicts a conventional drill bit coupled to a progressing cavity motor utilizing an exemplary stator embodiment of the present invention having first and second elastomer layers.

With reference now to FIG. 2, one exemplary embodiment of a Moineau style power section 200 according to this invention is shown in use in a downhole drilling motor 60. Drilling motor 60 includes a helical rotor 250 deployed in the helical cavity of progressing cavity stator 205. In the embodiment shown on FIG. 2, drilling motor 60 is coupled to a drill bit assembly 50 in a configuration suitable, for example, for drilling a subterranean borehole, such as in an oil and/or gas formation. It will be understood that the progressing cavity stator 205 of this invention, while shown coupled to a drill bit assembly in FIG. 2, is not limited to downhole applications, but rather may be utilized in substantially any application in which progressing cavity motors and/or pumps are used.

Figure 3:
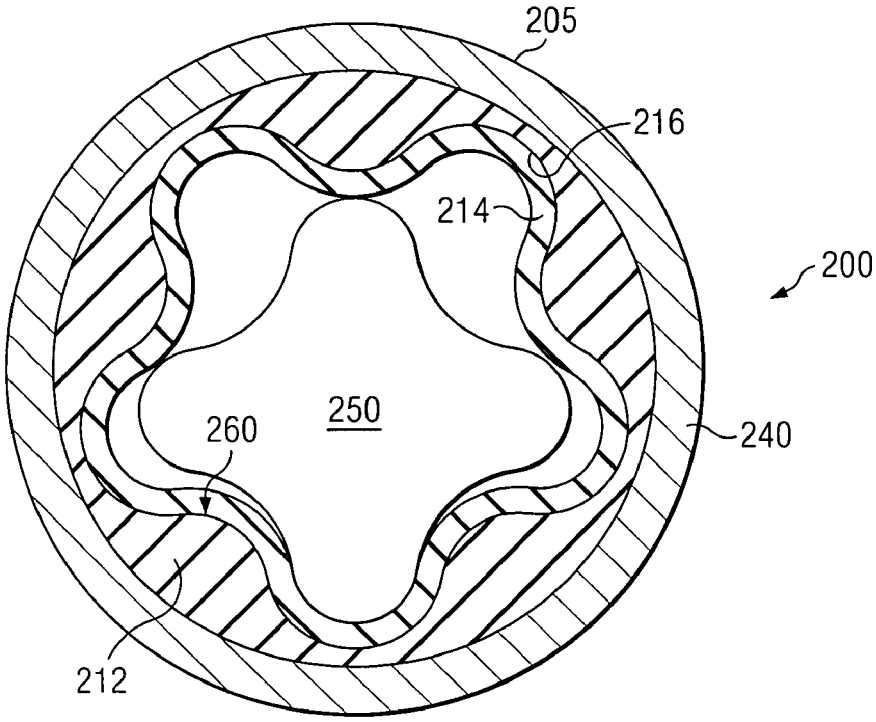
FIG. 3 is a circular cross sectional view of the progressing cavity stator as shown on FIG. 2.

Turning now to FIG. 3, which is a cross-section as shown on FIG. 2, power section 200 is shown in circular cross section. Progressing cavity stator 205 includes an outer tube 240 (e.g., a steel tube) retaining a helical cavity portion 210. Helical cavity portion 210 includes first and second elastomer layers 212 and 214. In the exemplary embodiment shown, the first elastomer layer 212 is shaped to define a plurality of helical lobes 260 (and grooves) on an inner surface 216 thereof. Second elastomer layer 214 is deployed, for example, as a liner on the inner surface 216 of the first elastomer layer 212. Elastomer layers 212 and 214 may be fabricated from substantially any suitable elastomer materials. In exemplary applications for use downhole in oil and gas exploration, the elastomer materials are advantageously selected in view of an expectation of being exposed to various oil based compounds. Such elastomer materials may also be expected to experience high service temperatures and pressures.

According to the embodiment of FIGS. 2 and 3, elastomer layers 212 and 214 are fabricated from corresponding first and second elastomer materials. Each of the first and second elastomer materials are selected to have at least one distinct material property. It will be appreciated that while two (or more) elastomer materials may share a property (e.g., both may be resilient), they are distinct in that material property if their respective performances with respect to that property are sufficiently different such that one of the elastomer materials behaves differently than the other under the same operating conditions. For example only, first and second elastomer materials may be said to have at least one distinct material property if one of the elastomer materials has a greater resilience than the other under the same operating conditions.

The first and second elastomer materials are advantageously selected such that their respective distinct material properties (and thus their respective performances during typical operating conditions) complement one another towards improving stator performance and potentially minimizing tradeoffs associated with selecting elastomer materials in prior art stators. For example, in one exemplary embodiment, first elastomer layer 212 may be selected to have a lower viscous modulus than the second elastomer layer 214, which, in general, results in less hysteresis (and therefore less heat build up) in first elastomer layer 212 during loading and unloading of the elastomer lobes. Second elastomer layer 214 may be selected to be more resistant to various chemical components (such as the drilling fluid and various hydrocarbons) found downhole. In prior art stators, elastomers having desirable hysteretic properties (e.g., lower viscous modulus) often have less-than-desirable chemical resistance properties. Likewise, elastomers having desirable chemical resistance properties often have less-than-desirable hysteretic properties (which tends to result in heat build up in the lobes). Thus a tradeoff in hysteretic and chemical resistance properties is often required in prior art stators. Exemplary embodiments of this invention obviate the need for such a tradeoff. Rather, the second elastomer layer 214, which is in contact with the drilling fluid, may be selected for its resistance to the drilling fluid, while the underlying first elastomer layer 212 may be selected to have a low viscous modulus (and thus desirable hysteretic properties). Such an exemplary embodiment may thus advantageously exhibit both improved chemical resistance to the drilling fluid and reduced heat build up in the stator lobes (and thus reduced degradation of the stator lobes).

In an alternative exemplary embodiment, a relatively soft, high wear resistant second elastomer layer 214 may be deployed on a relatively hard, reinforcing first elastomer layer 212. In prior art stators, hard reinforcing elastomers (i.e., elastomers with relatively high elastic modulus) tend to have compromised wear resistance and sealing ability. Thus a tradeoff in elastomer hardness on the one hand and wear resistance and sealability on the other is often required in prior art stators. Exemplary embodiments of this invention obviate the need for such a tradeoff. The second elastomer layer 214, which is in contact with the abrasive drilling fluid and the rotor 250, may be selected for its wear resistance properties and its sealing ability, while the underlying first elastomer layer 212 may be selected for its reinforcement properties (such as its hardness and rigidity, which may reduce heat build up in the lobes and may further increase output torque of a motor).

It will be appreciated that this invention is not limited by the above-described exemplary embodiments. Rather, first and second elastomer layers may be deployed having substantially any combination of complementary material properties. For example, in another exemplary embodiment the second elastomer layer 214 may be selected for its chemical resistance properties while the first elastomer layer 212 may be selected for its adhesion properties to stator tube 240. In yet another exemplary embodiment, the second elastomer layer 214 may be selected for its wear resistance, while the first elastomer layer 212 may be selected for its thermal conductivity and/or its resistance to high temperature degradation. The invention is not limited in this regard.

Figure 4A:
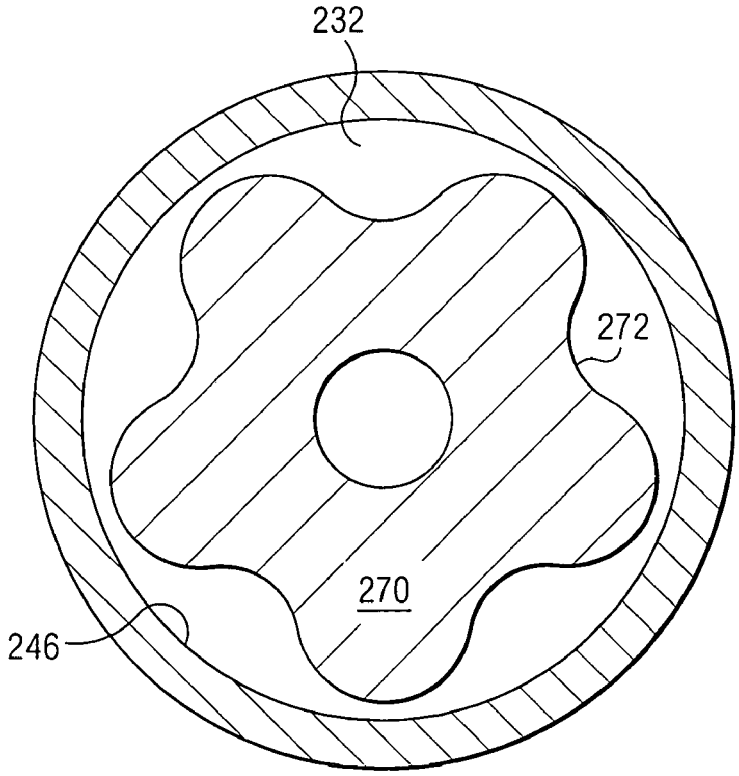
FIGS. 4A and 4B depict, in circular cross section, exemplary arrangements that may be used in the fabrication of the stator shown on FIGS. 2 and 3.

With continued reference to FIG. 3 and further reference to FIGS. 4A and 4B, one exemplary method will now be described for fabricating various embodiments of the progressive cavity stator of this invention. First elastomer layer 212 may be deployed on inner surface 246 of stator tube 240 using substantially any known methodology. For example, FIG. 4A shows a first stator core 270, having a plurality of helical grooves formed in an outer surface 272 thereof, deployed substantially coaxially in stator tube 240. Helical cavity 232 (the annular-like region between outer surface 272 and inner surface 246) is substantially filled with a first elastomer material, for example, using well known rubber injection techniques. It will be appreciated that inner surface 246 may be coated with a bonding compound prior to injection of the elastomer material to promote bonding between the first elastomer layer 212 and stator tube 240. Suitable bonding compounds include, for example, Lord Chemical Products Chemlock 250 or Chemlock 252X. In certain embodiments it may be advantageous to utilize aqueous based adhesives, such as Lord Chemical Products 8007, 8110, or 8115 or Rohm and Haas 516EF or Robond® L series adhesives.

After injection of the first elastomer layer 212, the stator preform (including stator core 270, first elastomer layer 212, and stator tube 240) is typically partially cured via heating in a steam autoclave. Although not required, such partial curing advantageously hardens the first elastomer layer 212 sufficiently so that stator core 270 may be removed from the preform, while leaving the elastomer layer 212 sufficiently under-cured to promote chemical cross linking with the second elastomer layer 214. For example, in one embodiment using partial curing, first elastomer layer 212 is cured to within a range of about 20 to about 80 percent of fully cured (e.g., depending on the type of elastomer material utilized and the degree of chemical cross-linking desired). After removal of the first stator core 270, the inner surface 216 of the first elastomer layer 212 is typically cleaned and may optionally be coated with a chemical adhesive, such as one of the Chemlock or Robond® L series adhesives listed above, to promote bonding and/or chemical cross-linking between the first 212 and second 214 elastomer layers.

Figure 4B:
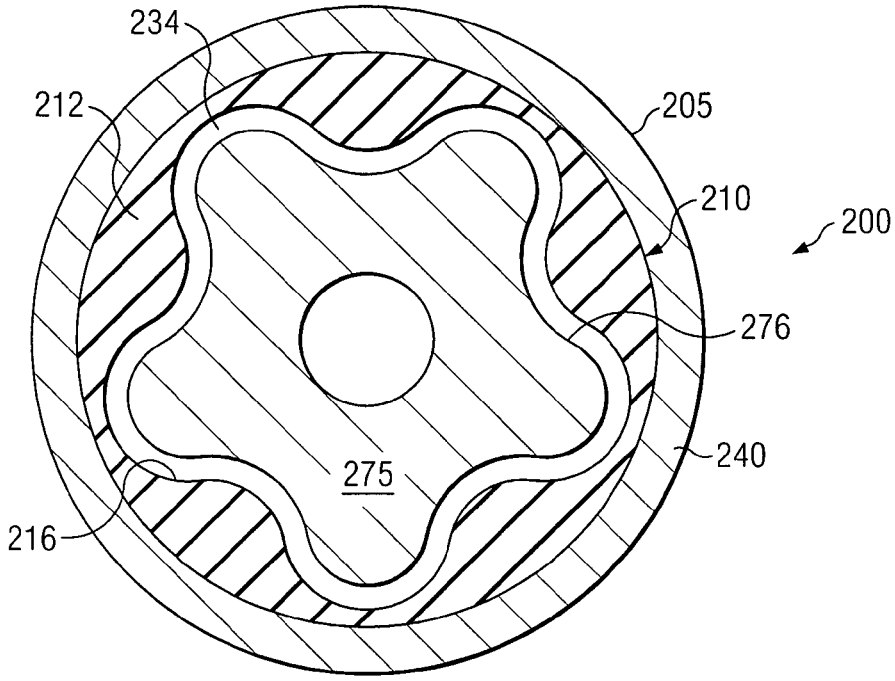

FIG. 4B shows a second stator core 275 deployed substantially coaxially in stator tube 240 and first elastomer layer 212. In the exemplary embodiment shown, stator core 275 has a substantially identical shape in circular cross section to that of stator core 270 (FIG. 4A), although the invention is not limited in this regard. Stator core 275 differs from stator core 270 in that it has smaller major and minor diameters than stator core 270, resulting in a helical cavity 234 between the outer surface 276 of stator core 275 and inner surface 216 of first elastomer layer 212. Helical cavity 234 is substantially filled with a second elastomer material (having at least one distinct material property than that of the first elastomer material, as described above) using convention elastomer injection techniques. After injection of the second elastomer material, the stator preform (now including outer tube 240, first elastomer layer 212, second elastomer layer 214, and stator core 275) may be fully cured in a steam autoclave prior to removing stator core 275.

As described above, first and second elastomer layers 212 and 214 may include substantially any suitable class of elastomer compounds, including, for example, elastomers having sulfur or peroxide based curing systems. It is generally desirable for the first and second elastomer materials to be selected from the same curing system (e.g., sulfur) to promote chemical cross-linking (chemical bonding) between the first and second elastomer layers 212 and 214. However, the invention is not limited in this regard. In one exemplary embodiment, first and second elastomer layers 212 and 214 include nitrile rubbers having sulfur based curing systems. In this exemplary embodiment, first elastomer layer 212 includes more carbon black than second elastomer layer 214 (100 parts of N762 carbon black versus 70 parts of N774 carbon black). In such an embodiment, first elastomer layer 212 is relatively hard (having a Shore A hardness of about 90), thermally resistant, and thermally conductive as compared to the second elastomer layer 214. Second elastomer layer 214 is relatively soft (having a Shore A harness of about 73) and more resistant to wear and oil based chemicals as compared to first elastomer layer 212. The resulting stator tends to advantageously resist both surface (wear and chemical attack) and bulk (thermal) degradation. Moreover, such a stator may provide for increased torque output per unit length as compared to conventional stators including a single elastomer layer.

Figure 5:
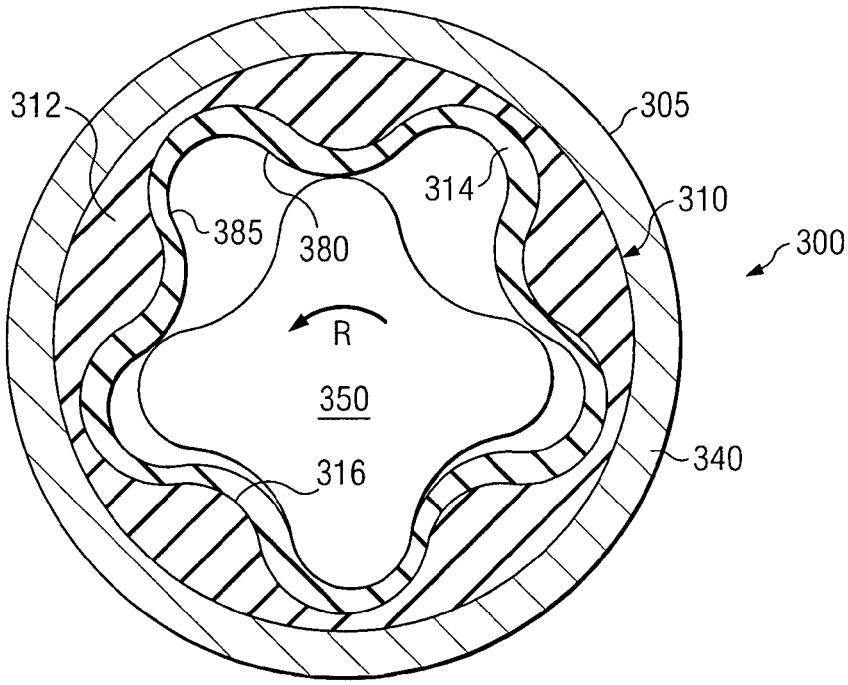
FIG. 5 depicts another embodiment of the present invention in circular cross section in which there is an asymmetric contouring within the deployment of the elastomer liner.

It will be appreciated that this invention is not limited to any particular cross-sectional shape of the first and second elastomer layers. For example only, FIG. 5 depicts an alternative embodiment of a power section 300 in accordance with this invention, in which the second elastomer layer 314 includes an asymmetric thickness. Part numbers identified on FIG. 5 in the 300 series correspond to part numbers identified on FIG. 3 in the 200 series. Comparing FIG. 5 now to FIG. 3, it will be seen that second elastomer layer 314 is asymmetrically contoured to provide thicker portions 380 and thinner portions 385. In the embodiment of FIG. 5, the Moineau style profile (i.e., having helical lobes 360) of the inner surface of the second elastomer layer 314 is rotationally offset from the Moineau style profile of the inner surface 316 of the first elastomer layer 312. In the exemplary embodiment depicted in FIG. 5, thicker portions 380 are advantageously deployed on the loaded sides of lobes 360 as shown by the arrow of rotation R of rotor 350. It will be appreciated that this invention is not limited by the direction of rotation of the rotor 350. In the exemplary embodiment shown, the thicker portions 380 have a thickness of about twice that of the thinner portions 385 located on the unloaded sides of lobes 360, although the invention is not limited in this regard.

Figure 6:
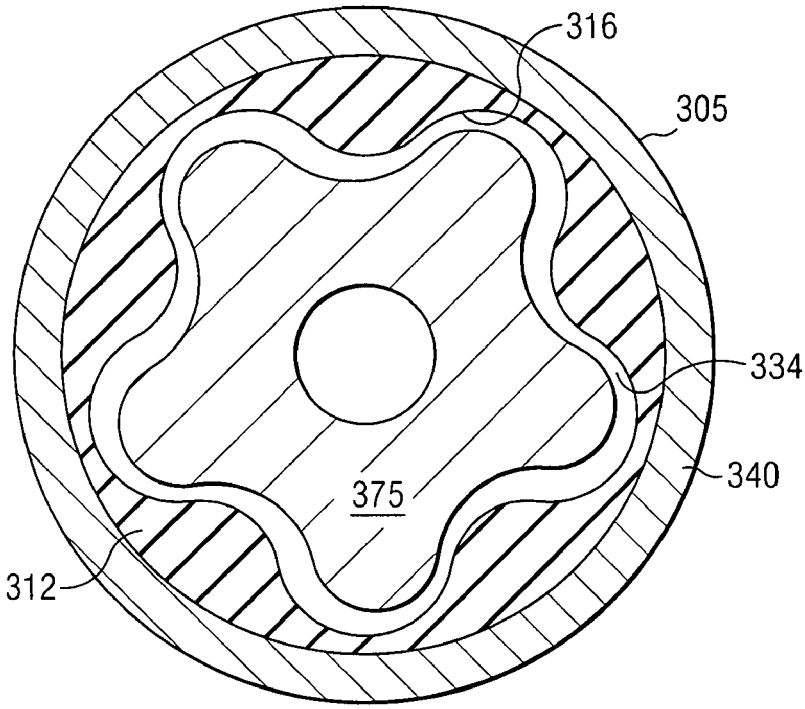
FIG. 6 depicts, in circular cross section, an exemplary arrangement that may be used in the fabrication of the stator shown on FIG. 5.

With reference now to FIG. 6, stator 305 may be fabricated in a manner similar to that of stator 205. In one exemplary embodiment, the fabrication process differs from that described above with respect to FIGS. 4A and 4B only in that second stator core 375 is rotationally offset with respect to the inner surface 316 of first elastomer layer 312 as shown on FIG. 6. The resulting helical cavity 334 has an asymmetric thickness, which when filled with elastomer results in a second elastomer layer 314 having relatively thicker 380 and thinner 385 regions (as shown on FIG. 5).

Figure 7:
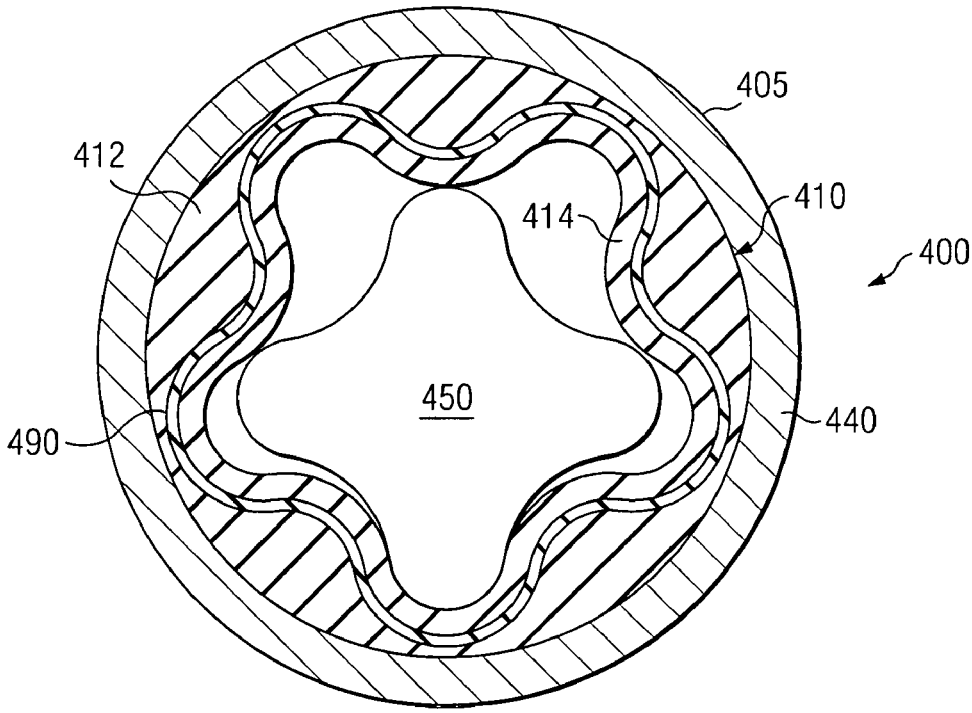
FIG. 7 depicts yet another embodiment of the present invention including, first, second, and third elastomer layers.

In other embodiments, such as the exemplary embodiment shown on FIG. 7, exemplary stators in accordance with this invention may include first, second, and third elastomer layers. For example, FIG. 7 depicts the exemplary embodiment shown on FIG. 3 having one transition layer 490 (the third elastomer layer) deployed between the first 412 and second 414 elastomer layers. Part numbers identified on FIG. 7 in the 400 series correspond to part numbers identified on FIG. 3 in the 200 series. In one exemplary embodiment, the transition layer 490 is advantageously made of a less resilient elastomer than the second elastomer layer 414, but of a more resilient elastomer than the first elastomer layer 412. In this way, deeper resilience in the stator lobes 460 may be achievable to facilitate the interference fit between rotor 450 and stator 405 as the rotor 450 rotates. A relatively hard first elastomer layer 412 may then be utilized, which advantageously minimizes heat build up and corresponding elastomer degradation. Moreover, as described above, a hard first elastomer layer 412 may advantageously increase stator efficiency and provide for increased torque output per unit length of the stator as compared to conventional stators including a single elastomer layer. Stator embodiments including first, second, and third elastomer layers may be fabricated in substantially the same manner as stators having first and second elastomer layers with the exception that first, second, and third stator cores are typically utilized.

With regard to transition layer embodiments, it will be appreciated that the invention is not limited to the foregoing description of the exemplary embodiment shown on FIG. 7 in which only one transition layer was described, and wherein the transition layer shape in circular cross section follows that of the other elastomer layers. It will be understood that embodiments of the invention may have multiple transition layers. Similarly other embodiments may have transition layers whose shape in circular cross-section varies from that of the other elastomer layers (e.g., resulting in one or more layers having an asymmetric thickness such as the embodiment described above with respect to FIG. 5).

Although the present invention and its advantages have been described in detail, it should be understood that various changes, substitutions and alternations can be made herein without departing from the spirit and scope of the invention as defined by the appended claims.

I claim:

1. A stator for use in a progressing cavity power section, the stator comprising:

an outer tube;

a helical cavity component deployed substantially coaxially in the outer tube, the helical cavity component providing an internal helical cavity and including a plurality of internal lobes, the helical cavity component being of a substantially all elastomer construction; and the helical cavity component further including first and second elastomer layers, each of the elastomer layers being of an all elastomer construction and being fabricated of corresponding first and second elastomer materials, each of the first and second elastomer materials selected to have at least one distinct material property, the first elastomer layer retained by the outer tube and the second elastomer layer deployed on the first elastomer layer.

2. The stator of claim 1, wherein the first and second elastomer materials are selected from the group consisting of sulfur based curing elastomers and peroxide based curing elastomers.

3. The stator of claim 1, wherein the first and second elastomer materials have compatible curing systems.

4. The stator of claim 1, wherein the first elastomer material is harder than the second elastomer material.

5. The stator of claim 1, wherein the second elastomer material is more resilient than the first elastomer material.

6. The stator of claim 1, wherein the first elastomer material has a lower viscous modulus than the second elastomer material.

7. The stator of claim 1, wherein the first elastomer material has a greater thermal conductivity than the second elastomer material.

8. The stator of claim 1, wherein the second elastomer material has a greater wear resistance than the first elastomer material.

9. The stator of claim 1, wherein the second elastomer material has a greater chemical resistance than the first elastomer material.

10. The stator of claim 1, wherein the first elastomer material has a higher carbon black concentration than the second elastomer material.

11. The stator of claim 1, wherein the first elastomer layer is cross-linked with the second elastomer layer.

12. The stator of claim 1, wherein the second elastomer layer has a non-uniform thickness such that, when viewed in circular cross section, the second elastomer layer includes a varying thickness profile.

13. The stator of claim 12 wherein the varying thickness profile includes thicker and thinner portions, and wherein the thicker portions are about twice as thick as the thinner portions.

14. The stator of claim 1, further comprising a third elastomer layer of a corresponding third elastomer material, the third elastomer material selected for having at least one material property distinct from the material properties of the first and second elastomer materials.

15. The stator of claim 14, wherein:

the second elastomer material is more resilient than the first elastomer material; and the third elastomer material is more resilient than the second elastomer material.

16. A subterranean drilling motor comprising:

a rotor having a plurality of rotor lobes on a helical outer surface of the rotor;

a stator including a helical cavity component, the helical cavity component providing an internal helical cavity and including a plurality of internal stator lobes, the helical cavity component being of an all elastomer construction;

the rotor deployable in the helical cavity of the stator such that the rotor lobes are in a rotational interference fit with the stator lobes, rotation of the rotor in a predetermined direction causing the rotor lobes to (i) contact the stator lobes on a loaded side thereof as the interference fit is encountered, and (ii) pass by the stator lobes on a non-loaded side thereof as the interference fit is completed; and the internal stator lobes including first and second elastomer layers, each of the elastomer layers being of an all elastomer construction and being fabricated of corresponding first and second elastomer materials, each of the first and second elastomer materials selected to have at least one distinct material property, the first elastomer layer reinforcing the second elastomer layer, the second elastomer layer disposed to engage an outer surface of the rotor.

17. The subterranean drilling motor of claim 16, wherein:

the first elastomer material is harder than the second elastomer material; and the second elastomer material has a greater wear resistance than the first elastomer material.

18. The subterranean drilling motor of claim 16, wherein:

the first elastomer material has a lower viscous modulus than the second elastomer material; and the second elastomer material has a greater chemical resistance than the first elastomer material.

19. The subterranean drilling motor of claim 16, wherein the first and second elastomer materials are selected from the group consisting of sulfur based curing elastomers and peroxide based curing elastomers.

20. The subterranean drilling motor of claim 16, wherein the second elastomer layer has a non-uniform thickness such that, when viewed in circular cross section, the thickness of the second elastomer layer on one side of each of the lobes is greater than the thickness of the second elastomer layer on an opposing side of each of the lobes.

21. The subterranean drilling motor of claim 16, further comprising a third elastomer layer of a corresponding third elastomer material, the third elastomer material selected for having at least one material property distinct from the material properties of the first and second elastomer materials.

* * * * *